US006544146B1

(12) United States Patent
Stearns et al.

(10) Patent No.: US 6,544,146 B1
(45) Date of Patent: Apr. 8, 2003

(54) METHODS AND APPARATUS FOR LINKING ARM AND LEG MOTIONS ON ELLIPTICAL AND OTHER EXERCISE MACHINES

(76) Inventors: Kenneth W. Stearns, P.O. Box 55912, Houston, TX (US) 77055; Joseph D. Maresh, P.O. Box 645, West Linn, OR (US) 97068-0645

( * ) Notice: Subject to any disclaimer, the term of this patent is extended or adjusted under 35 U.S.C. 154(b) by 0 days.

(21) Appl. No.: 09/540,061

(22) Filed: Mar. 31, 2000

(51) Int. Cl.[7] ..... A63B 22/04
(52) U.S. Cl. ..... 482/52; 482/51; 482/62
(58) Field of Search ..... 482/51, 52, 57, 482/58, 59, 60, 62, 63, 64, 65, 70, 79, 80

(56) References Cited

U.S. PATENT DOCUMENTS 5,916,065 A * 6/1999 McBride et al. ..... 482/57
5,957,814 A * 9/1999 Eschenbach ..... 482/51

* cited by examiner

*Primary Examiner*—Stephen R. Crow
*Assistant Examiner*—Tom Nguyen

(57) ABSTRACT

An exercise apparatus includes a frame, an arm driven member, a leg driven member, and a transmission assembly interconnected between the arm driven member and the leg driven member. At least one of the arm driven member and the leg driven member is pivotally connected to the frame. The transmission assembly is interconnected between the arm driven member and the leg driven member in such a manner that the two members are synchronized with respect to direction of movement and subject to independent influences.

20 Claims, 9 Drawing Sheets

133
133
100
130
PF
160
PG
150
150
140
PD
130
PE
PD
PE
PB
PC
PA
120
180
120
110

133
133
100
130
130
150
PC
150
140
PF
160
PG
PE
PA
PD
PB
180
120
PH
120
118
110

METHODS AND APPARATUS FOR LINKING ARM AND LEG MOTIONS ON ELLIPTICAL AND OTHER EXERCISE MACHINES

FIELD OF THE INVENTION

The present invention relates to exercise methods and apparatus and more particularly, to unique linkage arrangements between arm driven members and leg driven members which are suitable for use on elliptical exercise machines and other types of exercise equipment.

BACKGROUND OF THE INVENTION

Exercise equipment has been designed to facilitate a variety of exercise motions, many of which incorporate both arm and leg movements. Examples of such equipment include elliptical exercise machines (e.g., see U.S. Pat. Nos. 5,242,343, 5,423,729, 5,540,637, 5,725,457, and 5,792,026); free form exercise machines (e.g., see U.S. Pat. No. 5,290,211); rider exercise machines (e.g., see U.S. Pat. Nos. 2,603,486, 5,695,434, 5,997,446); glider/strider exercise machines (e.g., see U.S. Pat. Nos. 4,940,233, 5,795,268); stepper exercise machines (e.g., see U.S. Pat. No. 4,934,690); bicycle exercise machines (e.g., see U.S. Pat. Nos. 4,188,030, 4,509,742); and other, miscellaneous exercise machines (e.g., see U.S. Pat. Nos. 4,869,494, 5,039,088). These patents are incorporated herein by reference to show suitable applications for the present invention.

On many such exercise machines, arm driven members and leg driven members are synchronized to facilitate a coordinated "total body" exercise motion. The synchronized motion is considered advantageous to the extent that it makes the equipment relatively easy to use. On the other hand, the perceived quality of exercise tends to exceed the actual quality of the exercise because the arms typically perform very little work. In industry terminology, the arms are just along for the ride.

In contrast to the foregoing machines, other exercise machines have been developed to provide independent upper body exercise and lower body exercise. One such machine is the NordicTrack ski machine (as shown in U.S. Pat. No. 4,728,102). On machines of this type, both the perceived quality of exercise and the actual quality of exercise are relatively more strenuous. The unfortunate trade-off is that many people consider ski machines relatively difficult to use, due to the independent arm and leg motions.

As compared to the ski machines and other machines with independent motion, another shortcoming of the "synchronized" machines is that the handles are often constrained to move back and forth regardless of whether or not the user wishes to move his arms while moving his legs. In such cases, the arms can be a nuisance and/or a potential source of injury. One known solution to this problem is to alternatively pin the arms to respective leg driven members or the frame (as shown in U.S. Pat. No. 5,792,026). This approach leaves room for improvement to the extent that the exercise activity must stop in order to accommodate insertion of the pins, and/or there is a transition interval wherein the position of the arms is not dictated by either the leg driven members or the frame. In this regard, the U.S. Pat. No. 5,792,026 patent teaches that the arms may be exercised independent of the legs when the pins are entirely removed. However, this alternative mode of operation simply brings users back to the difficulties often associated with the ski machines (uncoordinated arm and leg movements), and it does not address the requirement that exercise activity cease in order to change modes. Recognizing that each of the foregoing types of total body exercise machines suffer certain shortcomings, room for improvement remains with respect to total body exercise machines.

SUMMARY OF THE INVENTION

The present invention provides unique methods and apparatus for linking a leg driven member and an arm driven member. The present invention may be implemented in various ways to achieve various results. For example, the present invention may be described in terms of constraining an arm driven member to be both (a) synchronized relative to a leg driven member and (b) movable through a variable range of motion while the leg driven member moves through a prescribed range of motion. The present invention may also be described in terms of constraining an arm driven member to be both (a) synchronized relative to a leg driven member and (b) selectively movable (or selectively "stoppable") at any time. The present invention may also be described in terms of constraining an arm driven member to be both (a) synchronized relative to a leg driven member and (b) subjected to resistance independent of the leg driven member. The present invention may also be described in terms of the position of the arm driven member being (a) alternatively determined by the frame and the leg member and (b) always determined by one or the other.

A preferred embodiment of the present invention generally includes a frame; a leg driven member; an arm driven member; and a transmission assembly. At least one of the leg driven member and the arm driven member is pivotally connected to the frame. The preferred embodiment transmission assembly includes a plurality of links interconnected between the leg driven member and the arm driven member in a manner which provides all of the attributes described in the preceding paragraph. More specifically, first and second links are pivotally connected to one another and pivotally interconnected between the leg driven member and the arm driven member in a manner which constrains the leg driven member and the arm driven member to pivot together in a common rotational direction. The range of motion of the arm driven member is a function of a distance between the pivot axis of the leg driven member and the pivot axis defined between the first and second links. Third and fourth links are pivotally connected to one another and pivotally interconnected between the frame and one of the first and second links. The third and fourth links facilitate adjustment of the pivot axis defined between the first and second links relative to the pivot axis of the leg driven member.

Certain additional benefits may be realized by connecting both a resistance device and a dampening device to at least one of the third and fourth links. Still other benefits may be realized by connecting a powered actuator to at least one of the third and fourth links.

The preferred embodiment of the present invention is described in greater detail below with reference to the accompanying figures. The preferred embodiment is considered advantageous because it requires simple mechanical parts, is relatively compact, and is relatively easy to incorporate into existing exercise equipment. However, the present invention is not limited to this particular embodiment, nor to the type of machine on which it is shown. Moreover, the present invention is applicable to different combinations of force receiving and/or limb moving members. Additional variations and/or advantages may become more apparent from the detailed description that follows.

BRIEF DESCRIPTION OF THE DRAWING

With reference to the Figures of the Drawing, wherein like numerals represent like parts throughout the several views.

DETAILED DESCRIPTION OF THE PREFERRED EMBODIMENT

Figure 1:
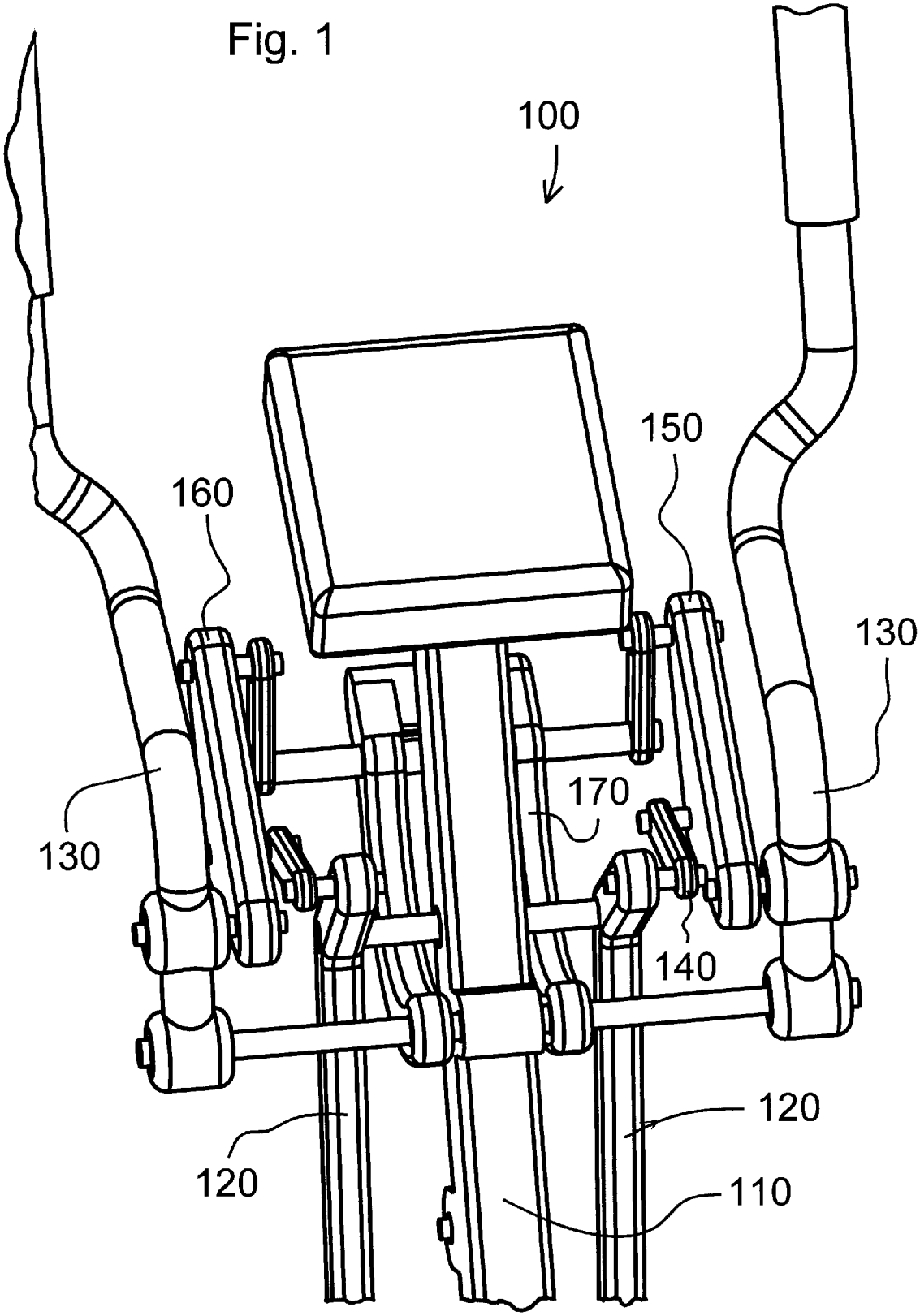
FIG. 1 is a first perspective view a preferred embodiment transmission assembly constructed according to the principles of the present invention.

A preferred embodiment transmission assembly constructed according to the principles of the present invention is designated as 100 in FIGS. 1–9. The transmission assembly 100 is shown on a preferred embodiment exercise apparatus 200, which may be generally described as an elliptical motion exercise machine that is similar in many respects to an exercise machine disclosed in U.S. Pat. No. 5,895,339 (which is incorporated herein by reference). However, the present invention is not limited to this specific type of exercise machine or any particular general category of exercise machine, but rather, is suitable for use on various sorts of exercise equipment having first and second limb exercising members. Examples of other suitable applications are mentioned above with reference to other patents which are incorporated herein by reference.

Both the transmission assembly 100 and the exercise apparatus 200 are generally symmetrical about a vertical plane extending lengthwise through the center of same, the only exception being the relative orientation of linkage assembly components on opposite sides of the plane of symmetry. Generally speaking, the "right-hand" components are one hundred and eighty degrees out of phase relative to the "left-hand" components. However, like reference numerals are used to designate both the "right-hand" and "left-hand" parts, and when reference is made to one or more parts on only one side of an apparatus, it is to be understood that corresponding part(s) are disposed on the opposite side of the apparatus. Also, the portions of the frame which are intersected by the plane of symmetry exist individually and thus, do not have any "opposite side" counterparts. Moreover, to the extent that reference is made to forward or rearward portions, it is to be understood that a person could exercise while facing in either direction relative to the linkage assembly.

The transmission assembly 100 is mounted on a frame member 110 and interconnected between a leg driven member 120 and an arm driven member 130. On the preferred embodiment 100, the leg driven member 120 is pivotally connected to the frame member 110 at pin joint or pivot axis PA, and the arm driven member 130 is pivotally connected to the frame member 110 at pin joint or pivot axis PB. However, alternative embodiments of the present invention may be constructed with one of the two driven members pivotally connected to the frame, and the other supported indirectly by the pivotally connected member and/or the frame.

The preferred embodiment transmission assembly 100 includes respective first and second "directing" links 140 and 150 which are operably interconnected between the leg driven members 120 and the arm driven members 130, and respective first and second "limiting" links 160 and 170 which are operably interconnected between the frame member 110 and the linkages formed by the directing links 140 and 150, The modifiers "directing" and "limiting" are used merely for ease of reference in both this description and the claims set forth below. Alternative embodiments of the present invention may be constructed with different linkage arrangements and/or alternative technologies.

The leg driven member 120 includes upper and lower segments which extend radially away from the pivot axis PA in generally opposite directions. A distal portion of the lower segment is connected to a leg exercise assembly which is described below. A distal portion of the upper segment is pivotally connected to a first portion of the first directing link 140 at pin joint or pivot axis PC. In other words, pivot axis PC is constrained to pivot about pivot axis PA together with the leg driven member 120.

The arm driven member 130 extends radially away from the pivot axis PB and terminates in a handle 133. An intermediate portion of the arm driven member 130 (relatively closer to the pivot axis PB than the handle 133) is pivotally connected to a first portion of the second directing link 150 at pin joint or pivot axis PE. In other words, pivot axis PE is constrained to pivot about pivot axis PB together with the arm driven member 130. A second portion of the second directing link 150 is pivotally connected to a second portion of the first directing link 140 at pivot axis PD.

Figure 3:
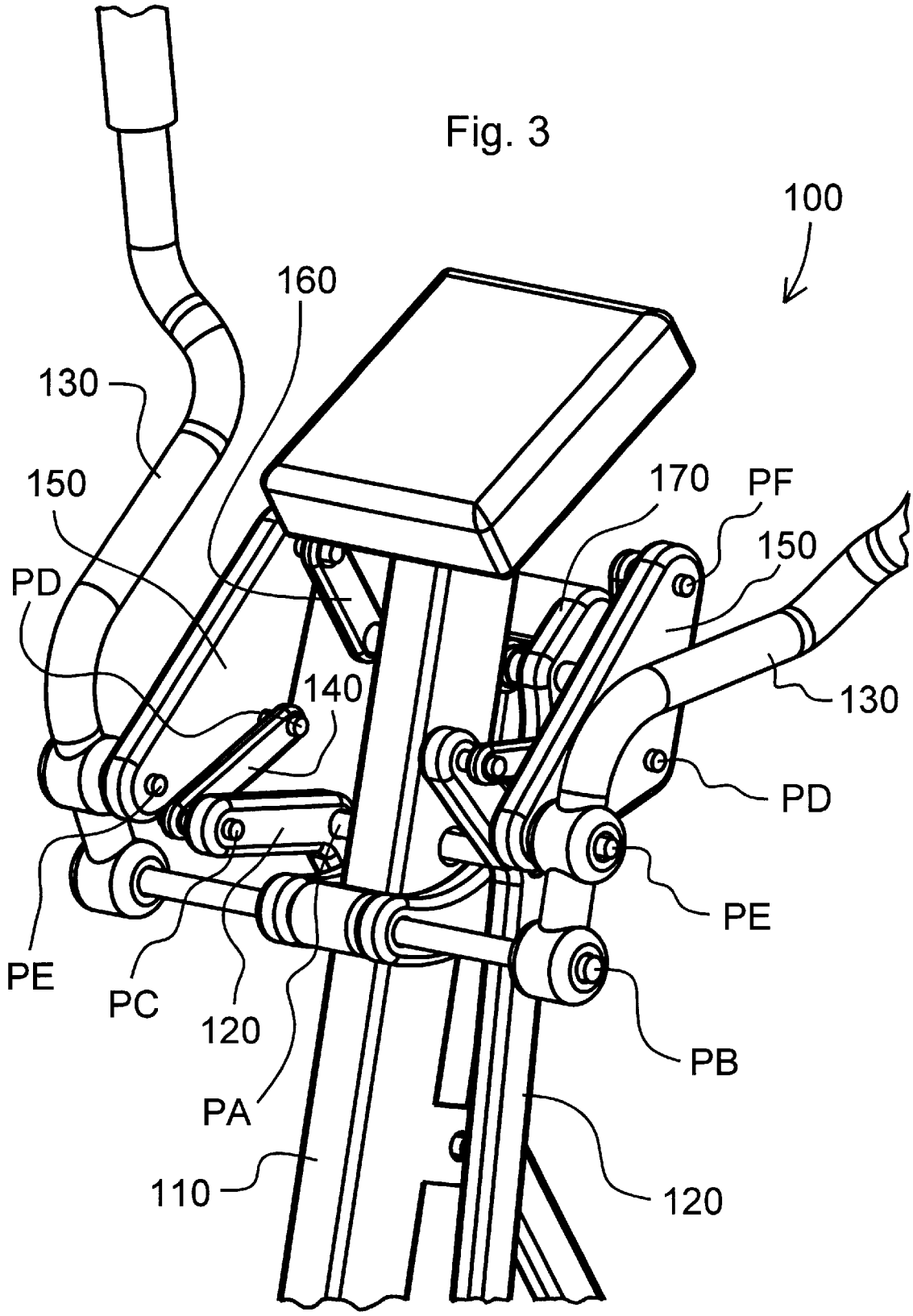
FIG. 3 is the same perspective view of the preferred embodiment transmission assembly of FIG. 2, with the right leg driven member at a relatively rearward position, and the handlebars available for movement through a relatively large range of motion.
Figure 4:
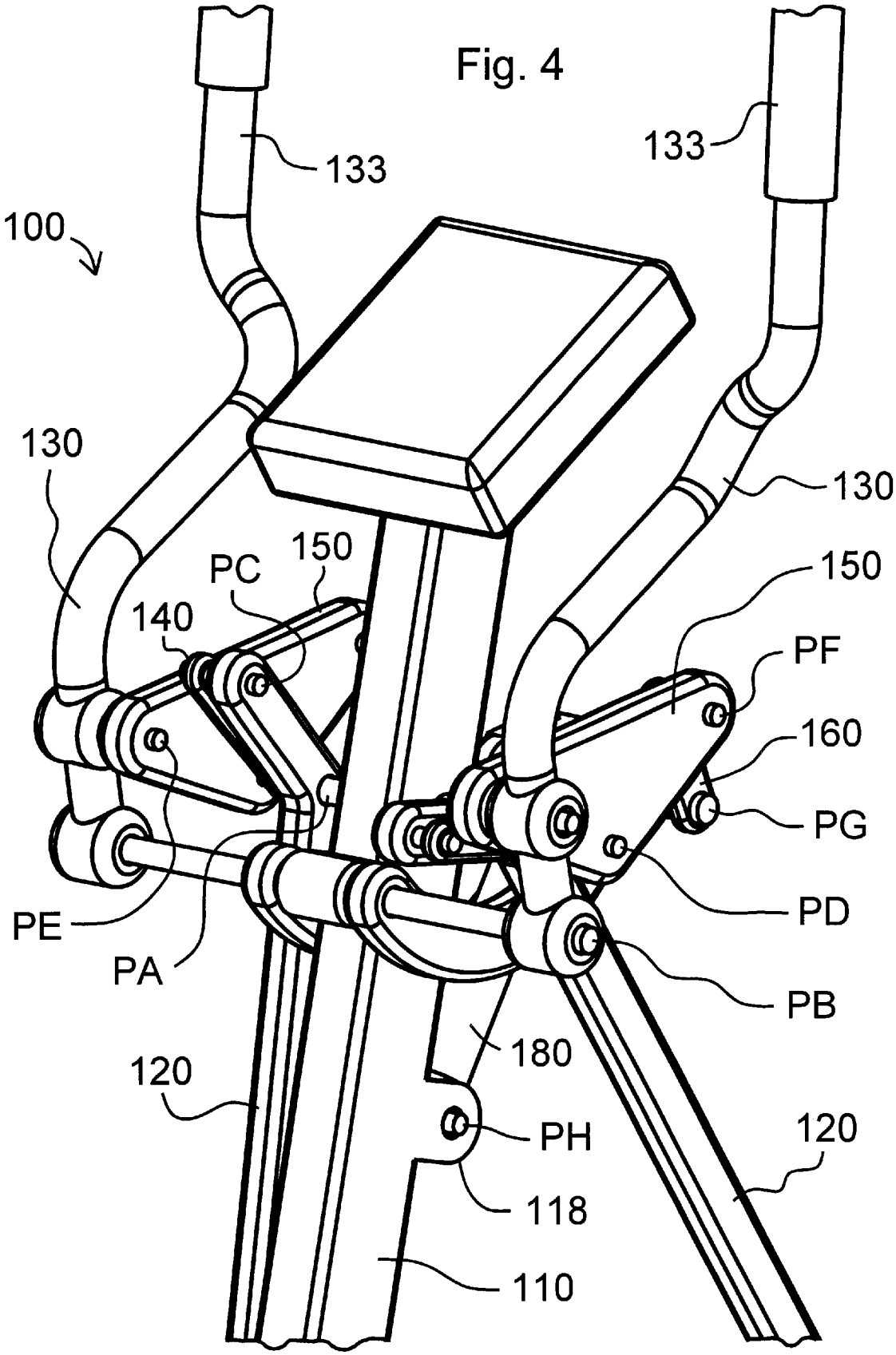
FIG. 4 is the same perspective view of the preferred embodiment transmission assembly of FIG. 2, with the right leg driven member at a relatively forward position, and the handlebars available for movement through a relatively small range of motion.
Figure 5:
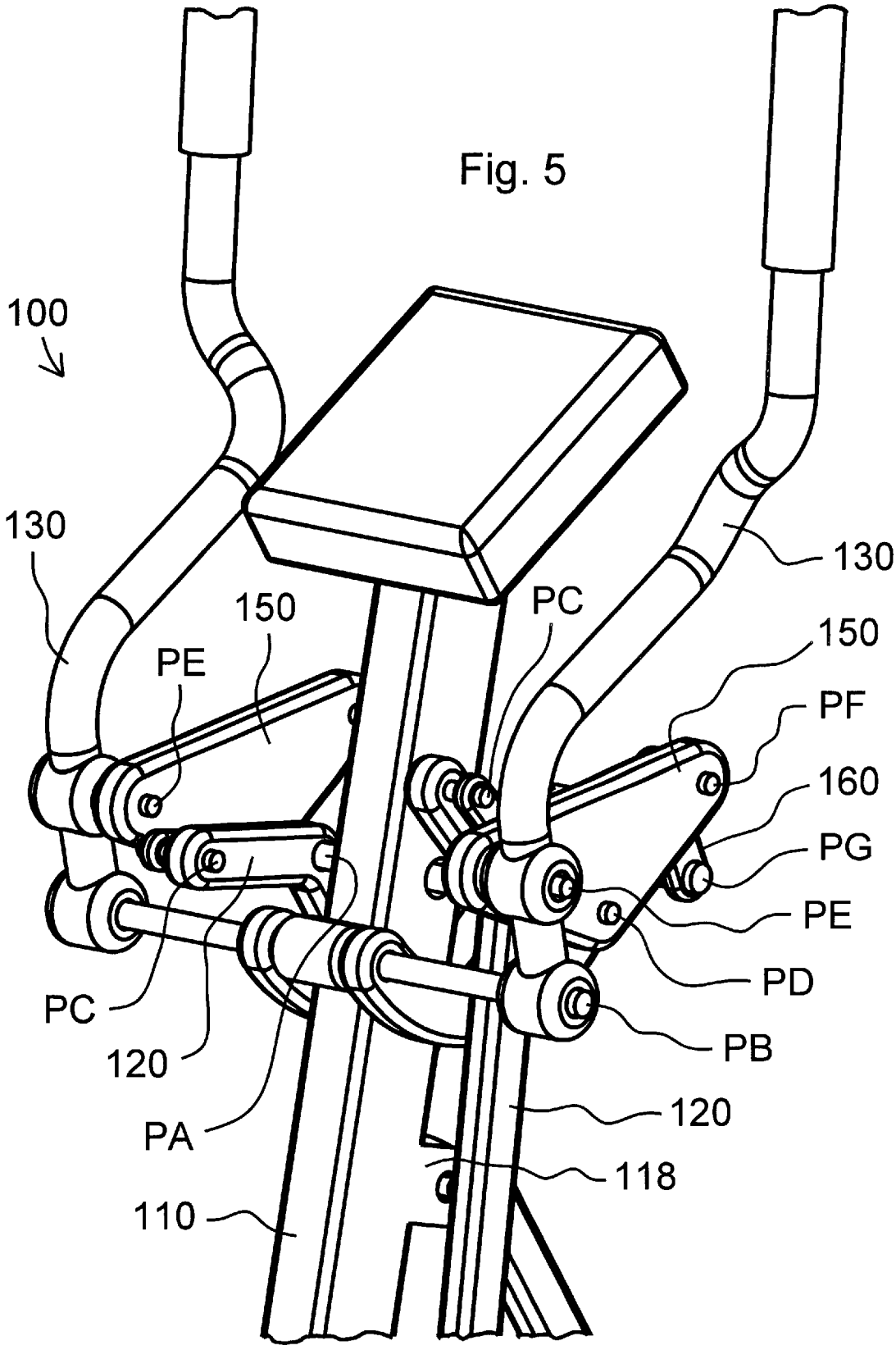
FIG. 5 is the same perspective view of the preferred embodiment transmission assembly of FIG. 2, with the right leg driven member at a relatively rearward position, and the handlebars available for movement through a relatively small range of motion.
Figure 6:
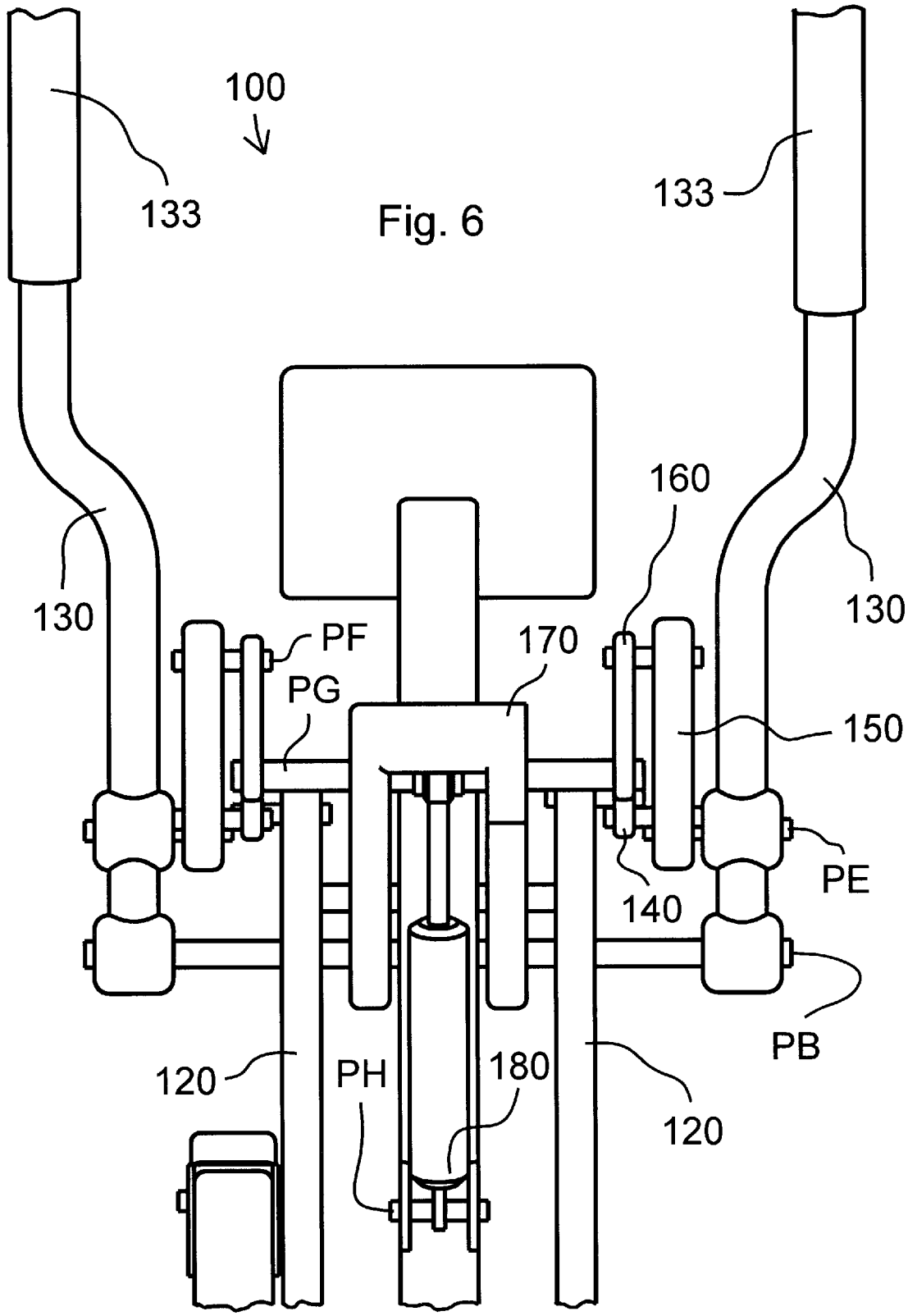
FIG. 6 is a front view of the preferred embodiment transmission assembly of FIG. 1.

The distance between the pivot axis PD and the pivot axis PC is approximately equal to the distance between the pivot axis PC and the pivot axis PA, and the pivot axis PD is movable into approximate alignment with the pivot axis PA (shown FIGS. 4–5). As the pivot axis PD approaches alignment with the pivot axis PA, the first directing link 140 is essentially limited to pivoting about the pivot axis PA together with the leg driven member 120, thereby imparting minimal translational effect on the second directing link 150. On the other hand, as the pivot axis PD moves away from alignment relative to the pivot axis PA (toward the configuration shown in FIGS. 2–3), the first directing link 140 tends to translate more (and rotate less) relative to the pivot axis PA, thereby imparting a more significant translational effect on the second directing link 150. The arrangement is such that the same side leg driven member 120 and arm driven member 130 pivot in a common rotational direction about their respective pivot axes PA and PB, and it may be configured so that the latter configuration (shown in FIGS. 2–3) provides a full arm swing, and the former configuration (shown in FIGS. 4–5) provides a greatly reduced arm swing and/or no perceivable arm swing. In this regard, it is to be understood that terms such as "minimal motion" or "minimum stroke length" are intended to include no movement, as well as relatively little movement. On the other hand, it is considered preferable that the handles 133 always move at least a small amount to (a) entice the user to begin arm exercise; and/or (b) at least convey to the user that the handles 133 are movable.

A first portion of the first limiting link 160 is pivotally connected to a third portion of the second directing link 150 at pin joint or pivot axis PF. A first portion of the second limiting link 170 is pivotally connected to the frame member 110 at the same pivot axis PB as the arm driven member 130. The provision of a common pivot axis PB is a matter of manufacturing convenience rather than necessity. A second portion of the second limiting link 170 is pivotally connected to a second portion of the first limiting link 160 at pin joint or pivot axis PG. In other words, pivot axis PG is constrained to pivot about pivot axis PB together with the second limiting link 170.

A telescoping member 180 is preferably interconnected between the second limiting link 170 (at pivot axis PG) and a trunnion 118 on the frame member 110 (at pin joint or pivot axis PH) . The telescoping member 180 includes a rod and a cylinder which are slidable back and forth relative to one another. In a manner already known in the art, the telescoping member 180 is configured both to dampen movement of the rod relative to the cylinder and to urge the rod toward a retracted position relative to the cylinder. For example, see U.S. Pat. No. 5,072,928, which is incorporated herein by reference. Additionally, the telescoping member 180 may be configured to limit the extent of telescoping movement, dampen the telescoping movement more in a first direction than in a second direction, and/or selectively adjust the telescoping limits, the dampening aspect(s), and/or the spring aspect of the telescoping member 180, if desired.

Figure 8:
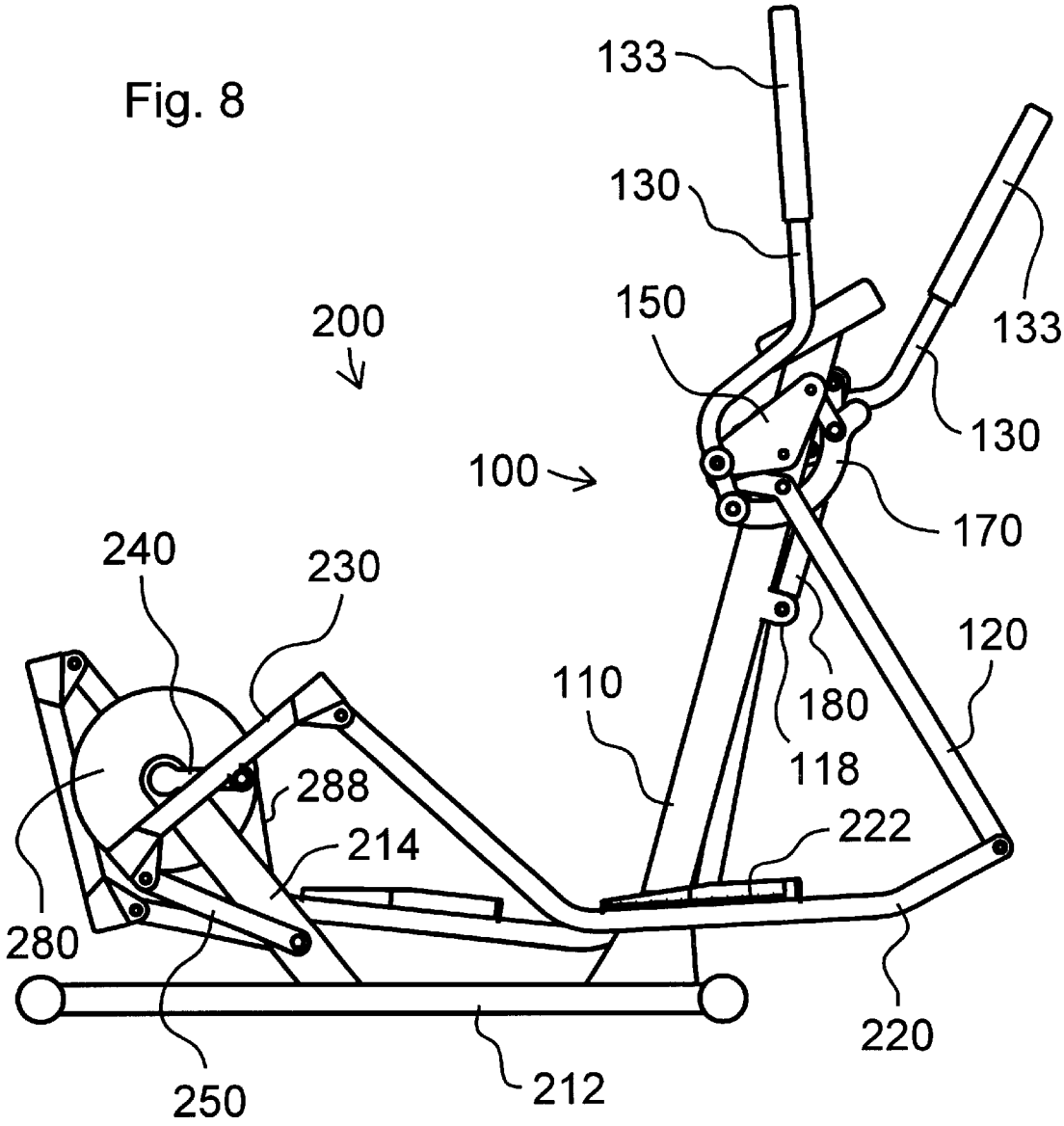
FIG. 8 is a side view of the preferred embodiment exercise apparatus of FIG. 7, with the preferred embodiment transmission assembly positioned as shown in FIG. 2.
Figure 9:
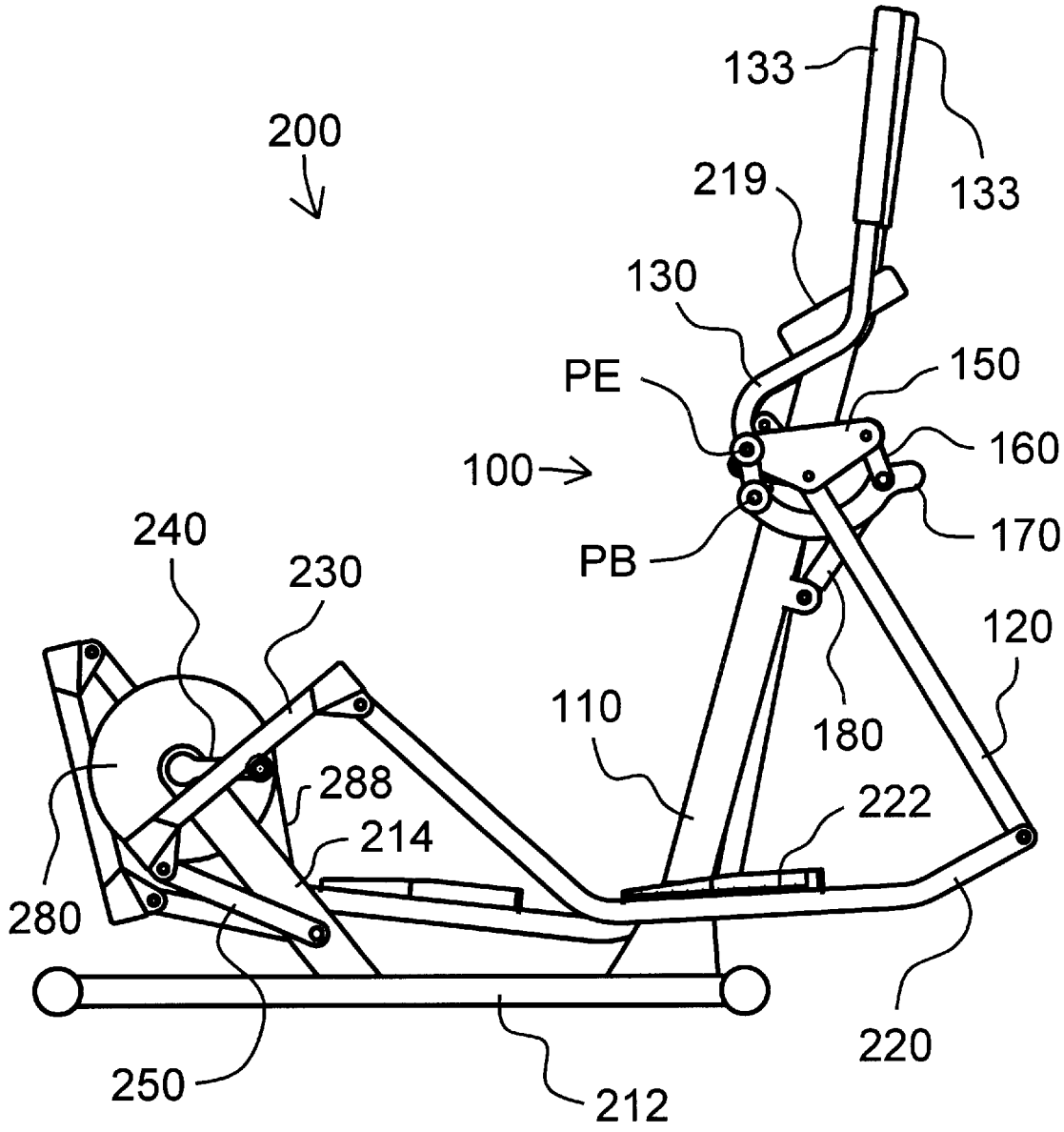
FIG. 9 is a side view of the preferred embodiment exercise apparatus of FIG. 7, with the preferred embodiment transmission assembly positioned as shown in FIG. 4.

In the absence of any outside influence, the spring in the telescoping member 180 pulls the second limiting link 170 forward and downward relative to the frame 110 (away from the position shown in FIG. 8, and toward the position shown in FIG. 9). In other words, the telescoping member 180 biases the assembly 100 toward the minimum stroke length configuration shown in FIGS. 4–5 and 9. The weight of the links 150, 160, and 170 also contributes to this bias force, and it may even be substituted for the spring on an alternative embodiment. The dampener in the telescoping member 180 prevents the assembly 100 from moving suddenly from either extreme to the other. Depending on the extent of the bias force, it may be desirable for the dampener to impose a greater restriction on retraction (as opposed to extension) of the telescoping member 180.

In response to an appropriate outside influence, the second limiting link 170 is pivotal in an opposite direction, upward and rearward about the pivot axis PB. On the preferred embodiment 100, the so-called "outside influence" is user applied force against one or both of the handles 133. In this regard, the user can increase the arm exercise stroke "on the fly" by pulling and/or pushing on respective handles 133 in a manner which is coordinated with movement of the leg driven members 120. Generally speaking, the length of the arm exercise stroke is a function of force exerted by the user against the handles 133 (under a given set of operating parameters). On the preferred embodiment 100, the dampening feature of the telescoping member 180 limits how much the length of the arm exercise stroke can change during a single exercise cycle. Regardless of the magnitude of the arm exercise stroke, the handles 133 remain synchronized with the leg driven members 120 at all times. If desired, the available range of motion may be selectively limited by adjusting a stop inside the telescoping member 180 and/or relative to one of the links in the assembly 100.

On alternative embodiments, the telescoping member 180 may be eliminated or replaced by other suitable devices. For example, a linear actuator may be substituted for the telescoping member 180, in which case the assembly may be adjusted automatically and/or more readily. In this situation, the "outside influence" may be a control signal generated by (a) the user pushing a button on the console 219; (b) a sensor detecting the presence or absence of the user's hands on the handles 133; (c) a sensor detecting the user's level of exertion for comparison to a target level or range; (d) an automated program; and/or (e) a person other than the user (such as a trainer) who is in communication with the apparatus.

Figure 7:
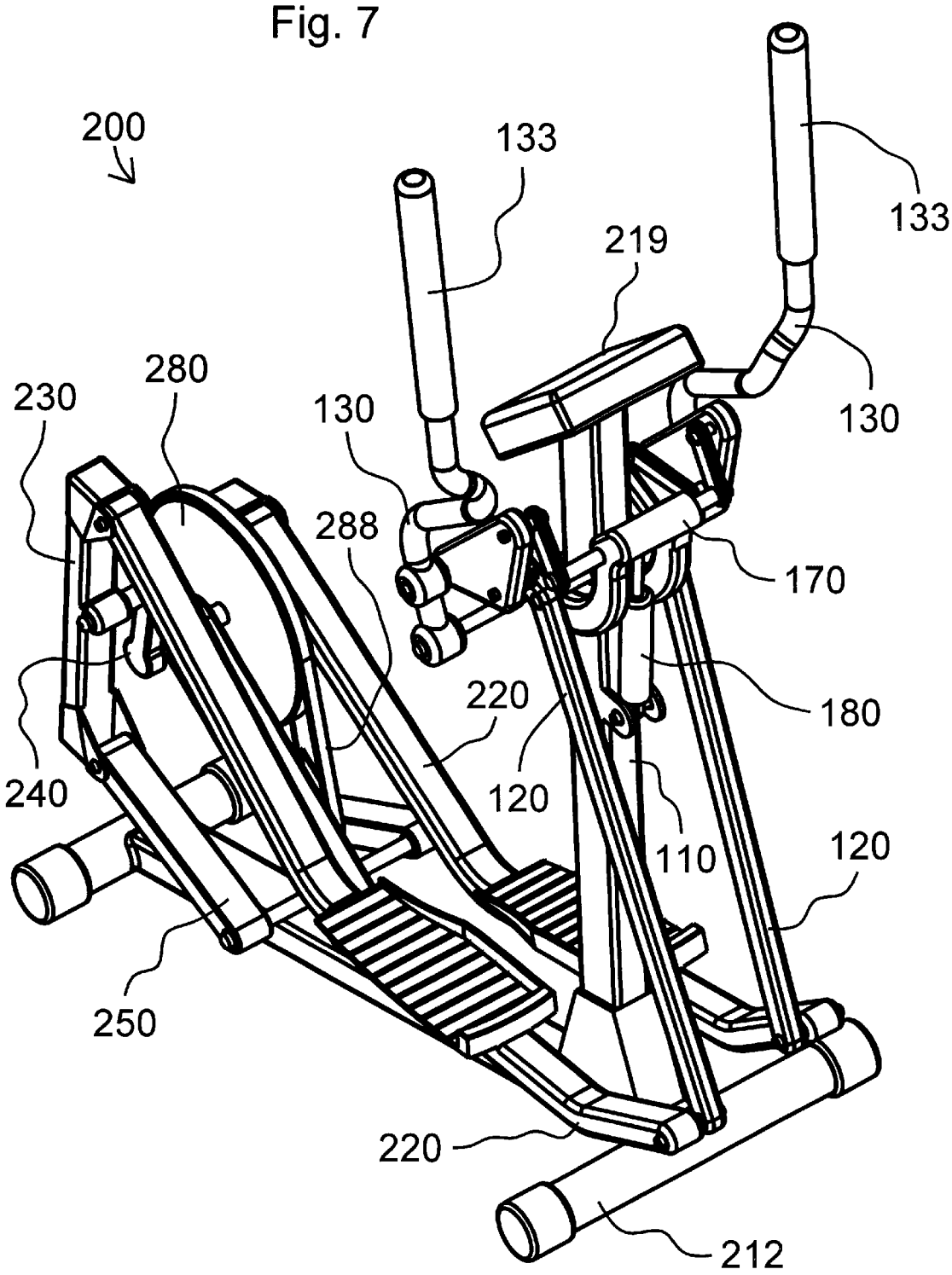
FIG. 7 is a perspective view of the preferred embodiment transmission assembly of FIG. 1 installed on a preferred embodiment exercise apparatus.

The preferred embodiment transmission assembly 100 is shown on a preferred embodiment exercise apparatus 200 in FIGS. 7–9. The leg exercising portion of the apparatus 200 is similar in many respects to the exercise machines disclosed in U.S. Pat. No. 5,895,339 (which was already incorporated herein by reference).

The frame member 110 (or forward stanchion) is connected to a base 212 which extends from a forward end to a rearward end and is configured to rest upon a floor surface. A rearward stanchion or frame member 214 extends upward from the base 212 proximate its rearward end. A linkage assembly (including the leg driven members 120) is movably interconnected between the rearward stanchion 214 and the forward stanchion 110. Generally speaking, the linkage assembly moves relative to the frame in a manner that links pivoting of the leg driven members 120 to generally elliptical motion of foot platforms 222. The term "elliptical motion" is intended in a broad sense to describe a closed path of motion having a relatively longer first axis and a relatively shorter second axis (which is perpendicular to the first axis).

In addition to the leg driven members 120, the linkage assembly generally includes left and right foot supporting members 220, left and right connector links 230, left and right cranks 240, and left and right rocker links 250. On each side of the apparatus 200, a crank 240 is rotatably mounted on the rear stanchion 214 via a common shaft. An intermediate portion of each connector link 230 is rotatably connected to a respective crank 240. A first distal portion of each connector link 230 is rotatably connected to a respective rocker link 250, and an opposite, second distal portion of each connector link 230 is rotatably connected to a rearward portion of a respective foot supporting link 220. An opposite, forward portion of each foot supporting link 220 is rotatably connected to a respective leg driven member 120. An intermediate portion of each foot supporting link 220 supports a respective foot platform 222.

Figure 2:
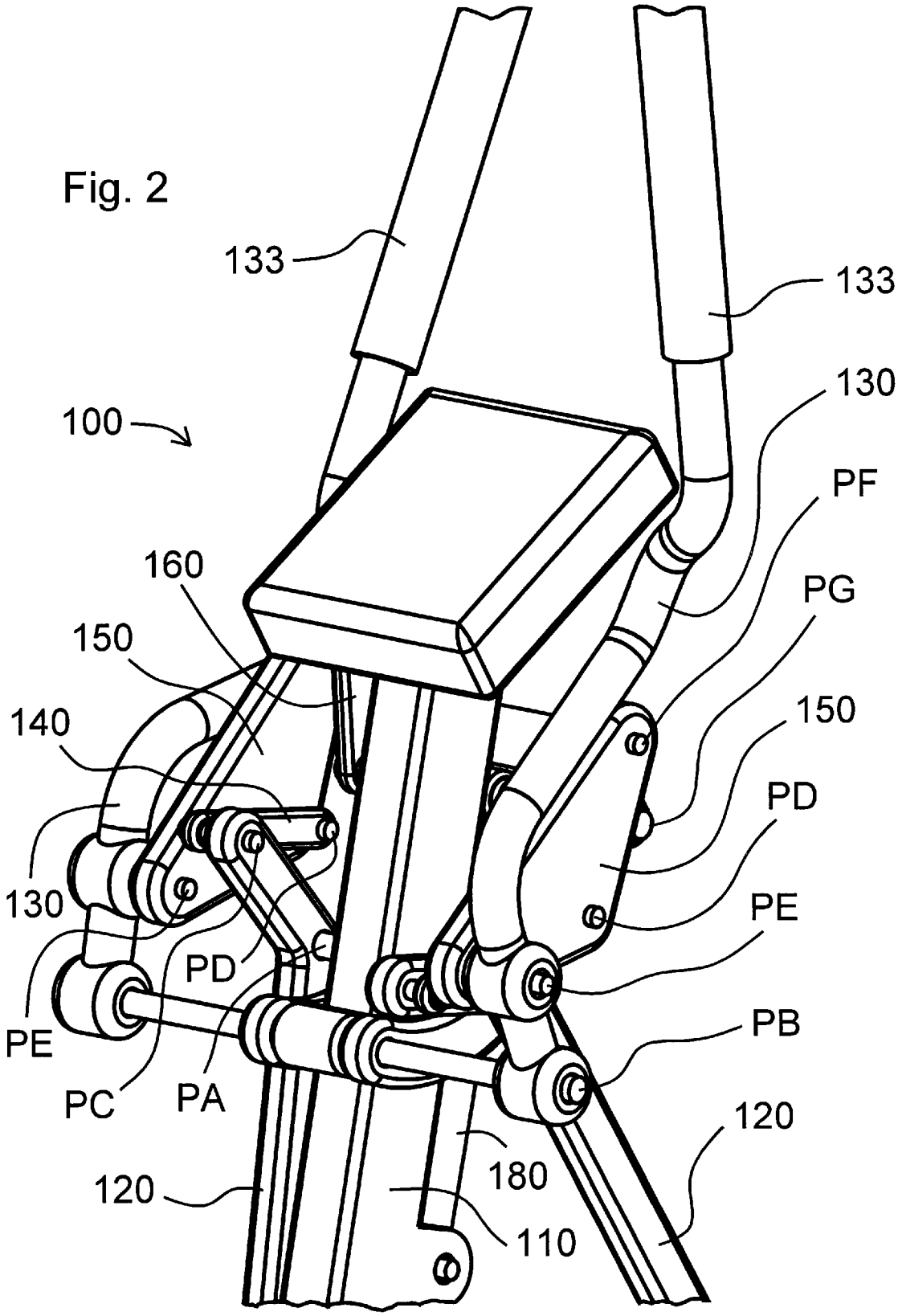
FIG. 2 is a second perspective view of the preferred embodiment transmission assembly of FIG. 1, with the right leg driven member at a relatively forward position, and the handlebars available for movement through a relatively large range of motion.

FIG. 8 shows the right and left foot supporting links 220 at respective forwardmost and rearwardmost positions and the corresponding positions of the handles 133 when the transmission assembly 100 is set for relatively large displacement (FIGS. 2–3). FIG. 9 shows the right and left foot supporting links 220 at respective forwardmost and rearwardmost positions and the corresponding positions of the handles 133 when the transmission assembly 100 is set for relatively small displacement (FIGS. 4–5). The operation of the leg exercising portion of the machine 200 is essentially identical in these two different situations, and no disruption of leg exercise is necessary in order to transition between the two situations.

A flywheel 280 is secured to the crank shaft and thereby constrained to rotate together with the cranks 240. The flywheel adds inertia to the linkage assembly, and any known flywheel resistance mechanism may be connected to the flywheel to add resistance, as well. For example, a drag strap 288 may be disposed about the circumference of the flywheel 280 and maintained in tension as shown in U.S. Pat. No. 4,023,795, which is incorporated herein by reference. Other suitable resistance mechanisms include known electrical braking arrangements and other known types of mechanical braking arrangements. Those skilled in the art will also recognize that the flywheel 280 could be replaced by a relatively large diameter pulley which is linked to a remote flywheel by means of a relatively small diameter pulley.

A user interface or console 219 is mounted on top of the forward stanchion 110. The console 219 may be configured to perform a variety of functions, including (1) displaying information to the user, including (a) exercise parameters and/or programs, (b) the current parameters and/or currently selected program, (c) the current time, (d) the elapsed exercise time, (e) the current speed of exercise, (f) the average speed of exercise, (g) the number of calories burned during exercise, (h) the simulated distance traveled during exercise, (i) material transmitted over the internet, and/or (j) amounts of work currently being performed by the user's arms and/or legs; (2) allowing the user to (a) select or change the information being viewed, (b) select or change an exercise program, (c) adjust the resistance to exercise (of the arms and/or the legs), (d) adjust the stroke length (of the arms and/or the legs), (e) adjust the orientation of the exercise motion, and/or (f) quickly stop the exercise motion (of the arms and/or the legs).

As noted above, in the absence of user applied force (or an alternative outside influence), the transmission assembly 100 will move toward and/or tend to remain in the configuration shown in FIG. 9 (with the handles 133 movable through a minimum range of motion). In this mode of operation, all of the exercise work is being performed by the user's legs.

By exerting force sufficient to overcome the bias force of the telescoping member 180, the user can gradually move the assembly 100 toward the configuration shown in FIG. 8 (with the handles 133 movable through a maximum range of motion). As long as the user applies force against the handles 133 which is sufficient to resist the spring force of the telescoping member 180, the machine will tend to remain in the FIG. 8 configuration. In this mode of operation, exercise work is being performed by both the user's arms and the user's legs, and the console 219 may be designed to display the effort of each. In this regard, the present invention may be described in terms of providing synchronized arm and leg movement while separately facilitating, monitoring, and/or displaying the work performed by each.

If the user stops exerting such force and/or simply releases the handles 133, the transmission assembly 100 will gradually move toward the FIG. 9 configuration (subject to the dampening effect of the telescoping member 180). The console 219 may be designed to, among other things, alert the user if arm exercise falls below a target level. In any event, the user may simply elect to "turn off" the arms to facilitate the performance of a secondary task, such as reading a book, browsing the internet, or taking a drink, or to focus only on lower body exercise, for example.

The present invention provides various methods which may be implemented in various ways. One such method is to provide arm and leg driven members which are synchronized but subject to independent resistance. Another such method is to provide arm and leg driven members which are synchronized but subject to independent ranges of motion. Yet another such method is to provide arm driven members which are secured to the frame whenever they are not moving in synchronization with respective leg driven members.

The present invention has been described with reference to a preferred embodiment and particular applications, but those skilled in the art will recognize additional embodiments, modifications, and/or applications which fall within the scope of the present invention. For example, the principles of the present invention may are also suitable for making "on the fly" adjustments to foot movements. Accordingly, the scope of the present invention is to be limited only to the extent of the claims which follow.

What is claimed is:

1. An exercise apparatus, comprising:

a frame designed to rest upon a floor surface;

an arm driven member;

a leg driven member, wherein at least one of the leg driven member and the arm driven member is pivotally connected to the frame; and a variable stroke transmission assembly interconnected between the leg driven member and the arm driven member in such a manner that when the leg driven member and the arm driven member are in motion during exercise (a) direction of motion of one said member is determined by direction of motion of the other said member, and (b) range of motion of the one said member is determined by an outside influence and is variable relative to range of motion of the other said member.

2. The exercise apparatus of claim 1, wherein the arm driven member is pivotally connected to the frame at a first pivot axis for reciprocal pivoting through an arc centered about the first pivot axis, and the leg driven member is pivotally connected to the arm driven member is determined by an outside influence and is variable without changing the range of motion of the leg driven member.

3. The exercise apparatus of claim 2, wherein the transmission assembly includes a first directing link and a second directing link, wherein the first directing link has a first portion pivotally connected to the leg driven member, and the second directing link has a first portion pivotally connected to the arm driven member, and a second portion of the first directing link is pivotally connected to a second portion of the second directing link.

4. The exercise apparatus of claim 3, wherein the transmission assembly includes a first limiting link and a second limiting link, wherein the first limiting link has a first portion pivotally connected to one of the first directing link and the second directing link, and the second limiting link has a first portion pivotally connected to the frame, and a second portion of the first limiting link is pivotally connected to a second portion of the second limiting link.

5. The exercise apparatus of claim 4, wherein a damper is interconnected between the second limiting link and the frame.

6. The exercise apparatus of claim 5, wherein a spring is interconnected between the second limiting link and the frame.

7. The exercise apparatus of claim 6, wherein the outside influence is a force applied by a person against the arm driven member and in opposition to a force applied by the spring.

8. The exercise apparatus of claim 7, wherein a handle is connected to an end of the arm driven member opposite the first pivot axis.

9. The exercise apparatus of claim 8, wherein a foot supporting link is connected to an end of the leg driven member opposite the second pivot axis.

10. The exercise apparatus of claim 9, wherein a crank assembly is connected to an end of the foot supporting link opposite the leg driven member, and the crank assembly and the leg driven member cooperate to direct a foot platform through a generally elliptical path.

11. The exercise apparatus of claim 4, wherein the first directing link and the second directing link cooperate to define a third pivot axis, and the range of motion of the arm driven member is a function of a radial distance defined between the third pivot axis and the second pivot axis.

12. The exercise apparatus of claim 11, wherein a damper is interconnected between the second limiting link and the frame.

13. The exercise apparatus of claim 12, wherein a spring is interconnected between the second limiting link and the frame.

14. The exercise apparatus of claim 13, wherein the outside influence is a force applied by a person against the arm driven member and in opposition to a force applied by the spring.

15. The exercise apparatus of claim 1, wherein the transmission assembly includes a first directing link and a second directing link, wherein the first directing link has a first portion pivotally connected to the leg driven member, and the second directing link has a first portion pivotally connected to the arm driven member, and a second portion of the first directing link is pivotally connected to a second portion of the second directing link.

16. The exercise apparatus of claim 15, wherein the transmission assembly includes a first limiting link and a second limiting link, wherein the first limiting link has a first portion pivotally connected to one of the first directing link and the second directing link, and the second limiting link has a first portion pivotally connected to the frame, and a second portion of the first limiting link is pivotally connected to a second portion of the second limiting link.

17. The exercise apparatus of claim 16, wherein a damper is interconnected between the second limiting link and the frame.

18. The exercise apparatus of claim 17, wherein a spring is interconnected between the second limiting link and the frame.

19. The exercise apparatus of claim 18, wherein the outside influence is a force applied by a person against the arm driven member and in opposition to a force applied by the spring.

20. The exercise apparatus of claim 15, wherein the leg driven member and the frame cooperate to define a fixed pivot axis that is fixed relative to the frame, and the first limiting link and the second limiting link cooperate to define a movable pivot axis that is movable relative to the frame, and the range of motion of the arm driven member is a function of a radial distance defined between the fixed pivot axis and the movable pivot axis.

* * * * *